United States Patent [19]

Omori et al.

[11] 4,353,237

[45] Oct. 12, 1982

[54] METHOD OF ROLLING STRIP

[75] Inventors: Shunji Omori, Aki; Tateo Tanimoto, Saiki; Nobutaka Maeda; Seiji Nishikawa, both of Hiroshima; Muneo Moriya, Saiki, all of Japan

[73] Assignee: Mitsubishi Jukogyo Kabushiki Kaisha, Japan

[21] Appl. No.: 136,985

[22] Filed: Apr. 3, 1980

[30] Foreign Application Priority Data

Apr. 17, 1979 [JP] Japan ..... 54/47057

[51] Int. Cl.[3] ..... B21D 1/05

[52] U.S. Cl. ..... 72/205; 72/163

[58] Field of Search ..... 72/205, 161, 199, 366, 72/242, 163

[56] References Cited

U.S. PATENT DOCUMENTS

| | | | |
|---|---|---|---|
| 438,846 | 10/1890 | Hine | 72/205 |
| 2,139,872 | 12/1938 | Worthington | 72/203 X |
| 2,303,143 | 11/1942 | Spangler | 72/205 |
| 2,370,895 | 3/1945 | Wean | 72/205 X |
| 3,238,756 | 3/1966 | Coffin, Jr. | 72/234 |
| 3,798,950 | 3/1974 | Franek et al. | 72/205 |
| 3,839,888 | 10/1974 | Greenberger | 72/205 X |
| 3,841,132 | 10/1974 | Kuhn et al. | 72/205 X |

*Primary Examiner*—Leon Gilden

*Attorney, Agent, or Firm*—McGlew and Tuttle

[57] ABSTRACT

In a method of rolling a strip between work rolls with small and large diameters, while tensioning and bending the strip, the diameter ratio of the small and large work rolls is chosen from the range of 1/1.5 to 1/10, at least one of the work rolls or of rolls in a group backing up the work rolls is driven, and the strip is rolled as it is forced through the work rolls while being bent toward or around either the small or large work roll at a strip entry-exit angle between 5° and 30°.

2 Claims, 8 Drawing Figures

Fig. 1
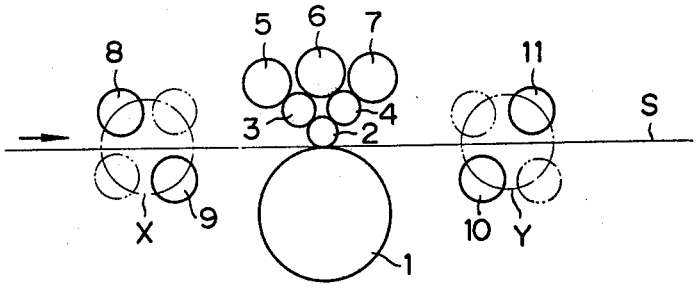
Fig.2(Ⅰ) Fig.2(Ⅱ) Fig.2(Ⅲ) Fig.2(Ⅳ)
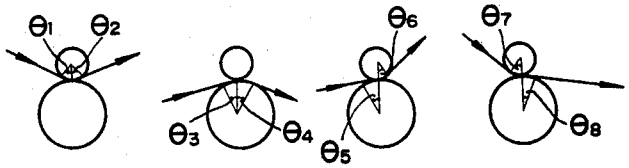
Fig. 3
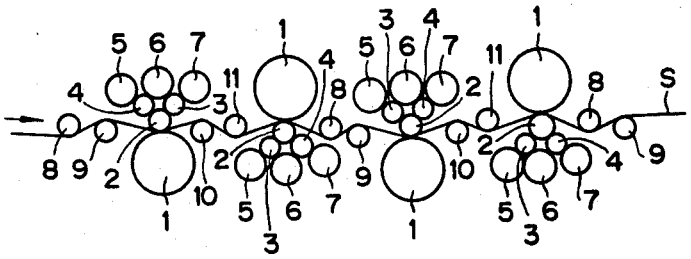

METHOD OF ROLLING STRIP

FIELD AND BACKGROUND OF THE INVENTION

This invention relates to a method of rolling a strip, especially a metal strip.

A known apparatus for practicing the method of this character is that made public by Japanese Patent Application Disclosure No. 25043/1972. As described in the specification of the cited application, we previously proposed a tensioning-bending strip rolling apparatus which, when rolling and flattering a strip by a set of small and large work rolls while giving it a predetermined tension or velocity difference by means of bridle rolls, bends the strip toward or around the small work roll, whereby a high draft is attained. The rolled product is satisfactorily controlled in shape, and, moreover, the apparatus is made compact in construction.

Our further intensive stuides and experiments have revealed that the bending of the strip around the small work roll is not essential, if the diameter ratio of the small and large work rolls is fixed within a certain range, if at least one of the small and large work rolls in a set or of the rolls in a group backing up the work rolls is driven, and if the strip is rolled while being bent to a suitable angle, or entry-exit angle. It has thus been found that, even when rolling a strip to a very thin sheet less than 0.2 mm in thickness, the tension control of the strip is easy and a good rolling result can be obtained.

As other approaches, apparatuses have already been proposed, including those taught by Japanese Patent Application Disclosure Nos. 5848/1979 and 10259/1979, for example, whereby a strip is rolled while being efficiently wound round a pair of work rolls. Those apparatuses have drawbacks however in that the pair of work rolls, with the same diameter, cannot fully achieve the effect of beinding a strip by applying a rolling pressure on the outer side of the curved workpiece, and therefore the rolling force required is great and a very thin sheet cannot be obtained by high-draft rolling. Furthermore, the apparatuses are inevitably large in size.

SUMMARY OF THE INVENTION

In contrast with the foregoing, the method of the present invention uses a set of small and large work rolls in a diameter ratio between 1/1.5 and 1/10 so that, for example, the work roll with the smaller diameter presses the outer side of the curved strip having a small radius of curvature. In this manner the outer surface of the strip is rolled smooth with a little rolling force required and the curvature is increased, and hence a sheet can be continuously rolled with a high draft. Moreover, the very little rolling force requirement permits a considerable reduction in size of the apparatus.

In brief, the method according to the invention is one for rolling a strip between a set of work rolls with small and large diameters, while tensioning and bending the strip, characterized in that the diameter ratio of the small and large work rolls is chosen from the range of 1/1.5 to 1/10, at least one of the work rolls or of rolls in a group backing up the work rolls is driven, and the strip is rolled as it is forced through the set of work rolls while being bent toward or around either the small or large work roll at a strip entry-exit angle between 5° and 30°.

The method of the invention will be described in more detail below with reference to the accompanying drawings showing embodiments thereof.

BRIEF DESCRIPTION OF THE DRAWINGS

In the drawings:

FIG. 1 is a schematic view of an embodiment of the roll arrangement for practicing the strip rolling method according to the invention;

FIGS. 2(I) to 2(IV) are views illustrating the relationships between different entry and exit angles that a strip forms to a set of work rolls;

FIG. 3 is a view similar to FIG. 1 but showing another embodiment of roll arrangement;

DESCRIPTION OF THE PREFERRED EMBODIMENTS

Figure 4:
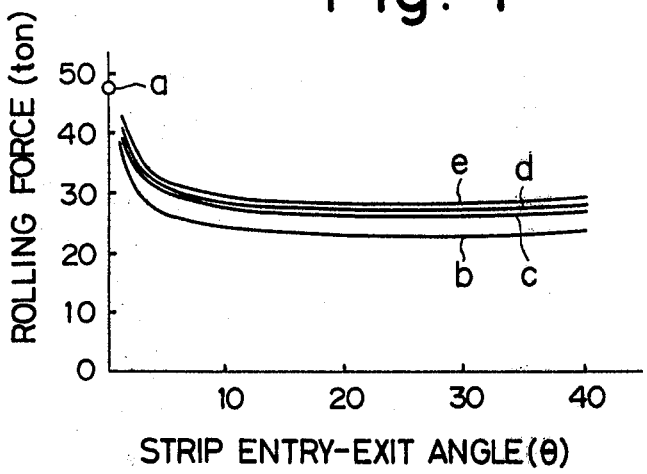
FIG. 4 is a graph showing the relationship between the entry-exit angle of strips and the rolling force required.

Referring to FIG. 1, there are shown a strip S, a work roll 1 with a large diameter, a work roll 2 with a small diameter, intermediate rolls 3, 4 supporting the small-diameter work roll, and backup rolls 5, 6, 7. In the roll arrangement embodied as shown, the large-diameter work roll 1 and the intermediate roll 4 are coupled to drives.

Also shown are deflector rolls 8, 9 disposed on the side of the cluster of rolls where the strip S enters and deflector rolls 10, 11 on the side where the strip leaves. The deflector rolls 8, 9 and 10, 11, in pairs, are causedto revolve as shown along the loci X and Y, respectively, so as to deflect the course of the strip toward the periphery of either the large or small work roll and permit the workpiece to pass through the set of work rolls at a desired entry-exit angle.

FIGS. 2(I) to 2(IV) illustrate four different modes of deflection of the strip, invaried directions at varied entry-exit angles ($\theta$). FIG. 2(I) shows the strip bent toward or around the small work roll, the entry angle ($\theta_1$) being equal to the exit angle($\theta_2$). The entry-exit angle ($\theta$) of the strip is expressed as $\theta=\theta_1+\theta_2$.

For the purposes of the invention, the term "entry angle" ($\theta_1$) is used to mean the angle formed between a line, which connects the center axis of the work roll around which the strip is bent with the point where thestrip begins contacting the particular roll, and a line connecting the same axis of the roll with the center of rolling. The term "exit angle" is used to mean the angle between a line, which connects the center axis of the work roll around which the strip is bent with the point where the strip leaves out of contact with the roll, and the line connecting the same axis of the roll with the center of rolling.

FIG. 2(II) shows the strip bent around the large work roll at entry and exit angles ($\theta_3$), ($\theta_4$) which are equal.

FIG. 2(III) shows the strip bent around the large work roll at an entry angle ($\theta_5$) as it runs into the set of rolls and bent around the small roll at an exit angle ($\theta_6$) as it emerges. In this case, $\theta_6>\theta_5$ (e.g., $\theta_5=8°$ and $\theta_6=20°$) and, as noted above, $\theta=\theta_5+\theta_6$ (i.e., 28°).

FIG. 2(IV) shows the strip bent first around the small work roll on the entrance side at an angle $\theta_7$ and then around the large roll on the exit side at an angle $\theta_8$.

These four modes of bending are of important significance in rolling. The mode in FIG. 2(I) proves markedly effective in operations where conditions are such that the outside diameter of the small work roll is relatively small for the thickness of the metal strip being rolled and that the unit tension being applied to the strip is so great that, regardless of wheter it travels around the small roll or not, the central portion in the width direction of the bent strip is plastically deformed (or stretched) by only bending stretching. In other words, the strip is straightened by the bending stretching immediately after, as well as before, rolling between the large and small rolls. This is a feature desirable for rolling metal into a thin sheet, because a high draft will be attained without the need of great rolling force, as will be described later.

In the mode illustrated in FIG. 2(II), the strip is bent around the large work roll and is rolled, with the small work roll in pressure contact with the upper side of the downwardly curved workpiece. Consequently, the compressive surface pressure against the strip is increased and the rolling force requirement is considerably less than when the strip is rolled without bending.

The mode of FIG. 2(III) is intended to achieve the same effect as in FIG. 2(II) by bending the strip around the large work roll on the entrance side and then bending it back in the same way as in FIG. 2(I), around the small roll on the exit side, so as to straighten the strip by tensile bending.

The mode of FIG. 2(IV), whereby strain is imparted to the strip on the entrance side, is effective in removing the longitudinal curl of the strip that results from rolling.

In practice these modes of bending and corresponding roll arrangements may be suitably employed, the choice depending upon the actual service conditions, such as the material and thickness of the strip, the desired thickness of the rolled product, and the draft to be attained.

FIG. 4 is a graphic presentation of the relationship between the entry-exit angle ($\theta$) and the rolling force, found in rolling experiments conducted with strips of the same material under the same tension for the same draft by means of a set of small and large work rolls in a diameter ratio of 1/8, both rolls not being directly driven. The point (a) represents the case where the strip was not bent at all. The curve (b) represents the case where the strip was bent around the small work roll as illustrated in FIG. 2(I); with the curve (c) representing the case corresponding to FIG. 2(III), the curve (d) the case corresponding to FIG. 2(IV), and the curve (e) the case where the strip was bent around the large work roll as in FIG. 2(II).

As can be seen from the graph of FIG. 4, the rolling force requirement decreases as the strip is bent at a suitable angle, i.e., over 5°, whereas a strip that is bent less needs a very great rolling force. Also, the rolling force required changes little when the strip is bent to entry-exit angles in excess of 30°, but the rolled strip tends to develop a difference in luster between the front and rear surfaces. For these reasons the strip entry-exit angle in the range of 5°–30° is desirable.

If, in the arrangement of FIG. 1, the small work roll 2 is not rigid enough to maintain the necessary rolling force between itself and the large work roll 2, it will be difficult to obtain a rolled strip with uniform thickness in the width direction. When such is the case, the required rigidity is provided in the usual way. Should the cluster arrangement of FIG. 1 still fail to impart an adequate rigidity, it would be necessary to increase the overall volume of the small work roll and the backing rolls combined, for example, by employing a larger number of the intermediate rolls. Even the large work roll must be supported, when it lacks sufficient rigidity, by backup rolls of its own.

Figure 5:
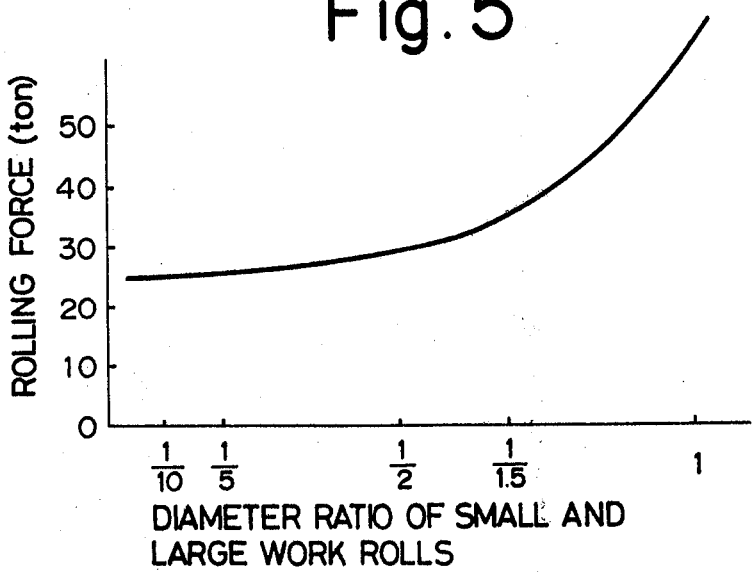
FIG. 5 is a graph showing the relationship between the diameter ratio of small and large work rolls and the rolling force required.

According to the present invention, the rolling force required can be decreased from that which is needed by a conventional set of work rolls with the same diameter, by about 25 to 50 %. FIG. 5 shows the relation between the diameter ratio of small and large work rolls and the rolling force required. Test strips were rolled between work rolls of varied diameter ratios, each time while being bent, as in FIG. 2(II), around the large work roll at an entry-exit angle of 10° (the entry and exit angles being 5° each).

It will be seen that sets of small and large work rolls, at the diameter ratios of over 1/1.5, tend to require progressively increased rolling forces. This means that a roll diameter ratio of not greater than 1/1.5 is desirable. Conversely where the ratio is less than 1/10, the rolling force requirement does not decrease and, moreover, the use of a large work roll with an increased diameter is an economic disadvantage. Hence, the diameter ratio of the small/large work rolls is desirably in the range from 1/1.5 to 1/10.

In the high-draft rolling of a metal strip, at which the method of the invention is aimed in particular, at least one of the roll groups, i.e., the work rolls 1, 2, intermediate rolls 3, 4 that support the work rolls, or the backup rolls 5, 6, 7, must be driven.

For example, the large work roll 1 must be directly driven. From the entrance to the exit side of the set of work rolls, the strip is reduced in thickness in proportion to the rolling reduction or draft attained. Given the same tension on the entrance and exit sides, therefore, the strip would indicate a greater unit tension at the exit than at the entrance. In addition, if the work rolls are not driven, the strip tension on the entrance side will decrease in inverse proportion to the energy that is required for rolling, thus widening the difference between the unit tensions on the two sides. Excessive unit tension on the exit side can have adverse effects upon some strip materials and often results in tensile failure or other trouble.

In order that the unit tensions on the entrance and exit sides be substantially equal, it is necessary to make up for the deficiency of energy required for rolling by the work rolls 1, 2 with additional energy supplied through either roll 1 or 2 or both and also increase the unit tension on the entrance side, in the opening between the work rolls 1, 2, in proportion to the ratio of the thickness of the strip on the exit side to that on the entrance side.

Where the large work roll alone can not increase the unit tension on the entrance side, drives are installed on the small work roll side, too.

Driving on the small roll side is accomplished in two ways; either the small work roll itself or an intermediate roll or rolls are directly driven.

The three features of the invention described above, viz., using a set of work rolls with different diameters in a certain ratio, driving at least one roll of the cluster, and bending the strip in the process of rolling, give such a synergetic effect without which continuous high-draft rolling of sheets would be infeasible.

FIG. 3 shows another embodiment of the present invention, or a plurality of cluster roll stands for practicing the method of the invention arranged in series for a continuous rolling operation.

In the same way as in FIG. 1, the numeral 1 indicates a work roll with a large diameter; 2, a small-diameter work roll; 3 and 4, intermediate rolls; 5, 6, 7, backup rolls; and 8, 9, 10, 11, deflector rolls.

In this case the strip S can be rolled to progressively increased drafts as it passes through the successive sets of work rolls until a very thin metal strip results. Because the strip is rolled while being bent in zigzag fashion, a flat strip is obtained without any longitudinal curling.

The method of the invention, as has been described above, makes it possible, for example, to roll an aluminum or copper alloy strip 0.3 mm in thickness into a 0.15 mm or thinner sheet in a continuous operation with only about 50 to 75% of the rolling force required by conventional four-high rolling mills. Even a 0.1 mm-thick strip can be rolled down to be as thin as about 0.05 mm. Furthermore, the rolled products are accurately shaped to advantage.

We claim:

1. A method of rolling a strip between two work rolls with small and large diameters respectively, for producing a relatively large amount of plastic deformation in the strip to substantially reduce the width of the strip, while tensioning and bending the strip, comprising: choosing the diameter ratio of said small and large work rolls to be in the range of 1/7 to 1/10; driving at least one of said work rolls or at least one roll in a group backing up said work rolls; rolling the strip as it is forced through said work rolls while bending the strip toward or away from either said small or large work roll at a strip entry-exit angle between 20° and 30°; and applying a pressure onto the strip using said rolls to squeeze the strip;

the pressure being sufficient to substantially plastically deform the strip by an amount which would require 25% to 50% more pressure if the entry-exit angle were zero and the small and large rolls were of equal diameter.

2. A method according to claim 1, wherein the strip is rolled in a single nip between said small and large rolls, a plurality of said small and large rolls provided for receiving said strip in series, each small and large roll defining only a single nip therebetween and a single nip in total defined by each of said small and large rolls.

* * * * *